United States Patent [19]

Powel et al.

[11] Patent Number: 4,890,743

[45] Date of Patent: Jan. 2, 1990

[54] SYSTEM AND PALLET FOR PACKAGING YARN SPOOLS

[75] Inventors: Stephen S. Powel; Robert J. Darby, both of Greensboro, N.C.

[73] Assignee: Cad/Cam Tooling, Inc., Greensboro, N.C.

[21] Appl. No.: 166,972

[22] Filed: Mar. 11, 1988

[51] Int. Cl.[4] ..... B65D 85/67

[52] U.S. Cl. ..... 206/595; 206/392

[58] Field of Search ..... 206/386, 595, 596, 598, 206/599, 600, 392

[56] References Cited

U.S. PATENT DOCUMENTS 4,042,108 8/1977 Brethauer ..... 206/392

4,253,570 3/1981 O'Connor et al. ..... 206/386 X 4,580,680 4/1986 Wind ..... 206/386

*Primary Examiner*—William Price

*Attorney, Agent, or Firm*—Rhodes, Coats & Bennett

[57] ABSTRACT

An improvement in a system for palletizing yarn packages or other cylindrical-core-wound goods includes molded plastic pallets, a first one of which supports a plurality of yarn spools thereon and a second one of which acts as a cover; the improved pallets including a centrally disposed tubular or cylindrical wall defining a gripping aperture having an inner diameter substantially equivalent to the inner diameter of the yarn tubes. So configured, during the stacking and unstacking of the yarn packages and pallets, the pallets may be lifted and transported by the same mechanical gripping device used to lift and transport the yarn packages.

1 Claim, 5 Drawing Sheets

SYSTEM AND PALLET FOR PACKAGING YARN SPOOLS

SUMMARY OF THE PRESENT INVENTION

The present invention is related to a system for constructing and breaking down palletized packages of goods, particularly core-wound strand material; and more specifically to the provision of unique molded pallets which significantly improve the overall palletizing operation.

The transportation and storage of yarn packages, most frequently wound on cylindrical tubes, is accomplished generally by arranging the individual spools or packages on pallets which may or may not include projections depressions, etc. which engage the winding tubes to prevent lateral shifting of the spools. The construction of the palletized unit involves the movement of the individual yarn packs by mechanical gripping devices onto/off the pallets. The mechanical gripping means may be one of several types, but generally includes a gripper head that is inserted into the hollow tube, on which the yarn is wound, and includes fingers or segments which expand or otherwise engage the inner surface of the tube to grip, lift and move the yarn to another location. Alternate types include gripper heads comprised of gripping fingers which grasp the outer surfaces of the goods or a core projection thereof, to lift and move the goods.

In both the building and the breaking down of a palletized unit there is a need to handle the goods and the pallets quickly, without damage to either; and a need to protect operators from fatigue and injury. While the above-described gripping devices have been in use for many years to handle yarn packs, the pallets have for the most part remained a manually handled item.

U.S. Pat. No. 4,042,108 teaches a molded plastic pallet which includes means for lifting and moving the pallets by some type of mechanical means. However, there is no known pallet specifically designed to be lifted, loaded, stacked/unstacked, etc. by the same gripping device used to handle the yarn. Previously, either two mechanical handlers have been required, or the pallets were manually handled by an operator. Such required use of two mechanical handling devices has rendered mechanical handling of pallets highly impractical. The spacial requirements alone are prohibitive because two mechanical handlers can substantially consume the space allotted for the entire operation, thus leaving no available space for storage of pallets and other supplies. Further, it is highly time consuming to use separate handling devices or to handle the yarn spools by one means and the pallets manually. Therefore, when the costs involved with purchase of two handlers are added to the increased spacial and time requirements, it is shown that the total is significantly higher than the cost of handling manually. Because of this, most facilities have depended on operators to handle the pallets even though it requires more time and energy.

The present invention is directed to a pallet designed for supporting and packaging core-wound materials and which includes a means incorporated into the molded pallet for handling the pallet by the same mechanical gripping device used for handling the goods. In the preferred embodiment the design of the present pallet is particularly suited for packaging yarn which is wound on cylindrical tubes. These spools are generally handled by means of the aforedescribed gripping head which is inserted into the tube and expanded or otherwise engaged by friction therein to grip and transport the yarn package. The present pallet includes a centrally disposed aperture formed by a tubular wall defining a cylindrical gripping area therein. The cylindrical gripping aperture has an inner diameter equivalent to the inner diameter of the yarn winding tube. Thus configured, the same mechanical gripping device can be utilized for stacking and unstacking the yarn and the pallets. The gripping head, when activated, engages the tubular wall defining the aperture in the same manner as the head engages the yarn spool tube.

The pallet is made of a tough, molded plastic and is designed such that when empty, the pallets nest together to form a manageable stack. By utilizing the centrally disposed apertures, all of which would be aligned when the pallets are stacked, a plurality of pallets can be held on the mechanical gripping device at one time. The number of empty pallets which could be lifted at one time would be determined at least partially by the depth of the mechanical gripping head.

Alternate embodiments of the improved pallet which might be used for different types of yarn spools, or any item being loaded onto or unloaded from a pallet by a mechanical device which grips a projection or engages the outer surface of the item itself, include upwardly extending knobs or projections which can be grasped by a gripping head comprised of a plurality of fingers.

The knobs or projections, or the previously described cylindrical aperture, are preferably centrally disposed on the pallet. However, in some embodiments it may be desirable to position one or more in other areas of the pallet.

A further improvement to the palletized package is the use of a separator grid which is placed between the supporting pallet and the yarn spools, or between layers of yarn spools. The separator grid is a molded grid having a substantially square or rectangular shape compatible with the shape of the pallets, and further includes integral, vertically extending projections which fit into the ends of the yarn spool tubes to prevent lateral shifting thereof. Separator grids which are used intermediately between layers of yarn include detachable projections which are secured to the underside of the grid such that upper and lower yarn spool tubes are engaged.

Other and further advantages will become apparent to those skilled in the art as the following detailed description is studied in conjunction with the accompanying drawings.

DETAILED DESCRIPTION OF A PREFERRED EMBODIMENT

Figure 1:
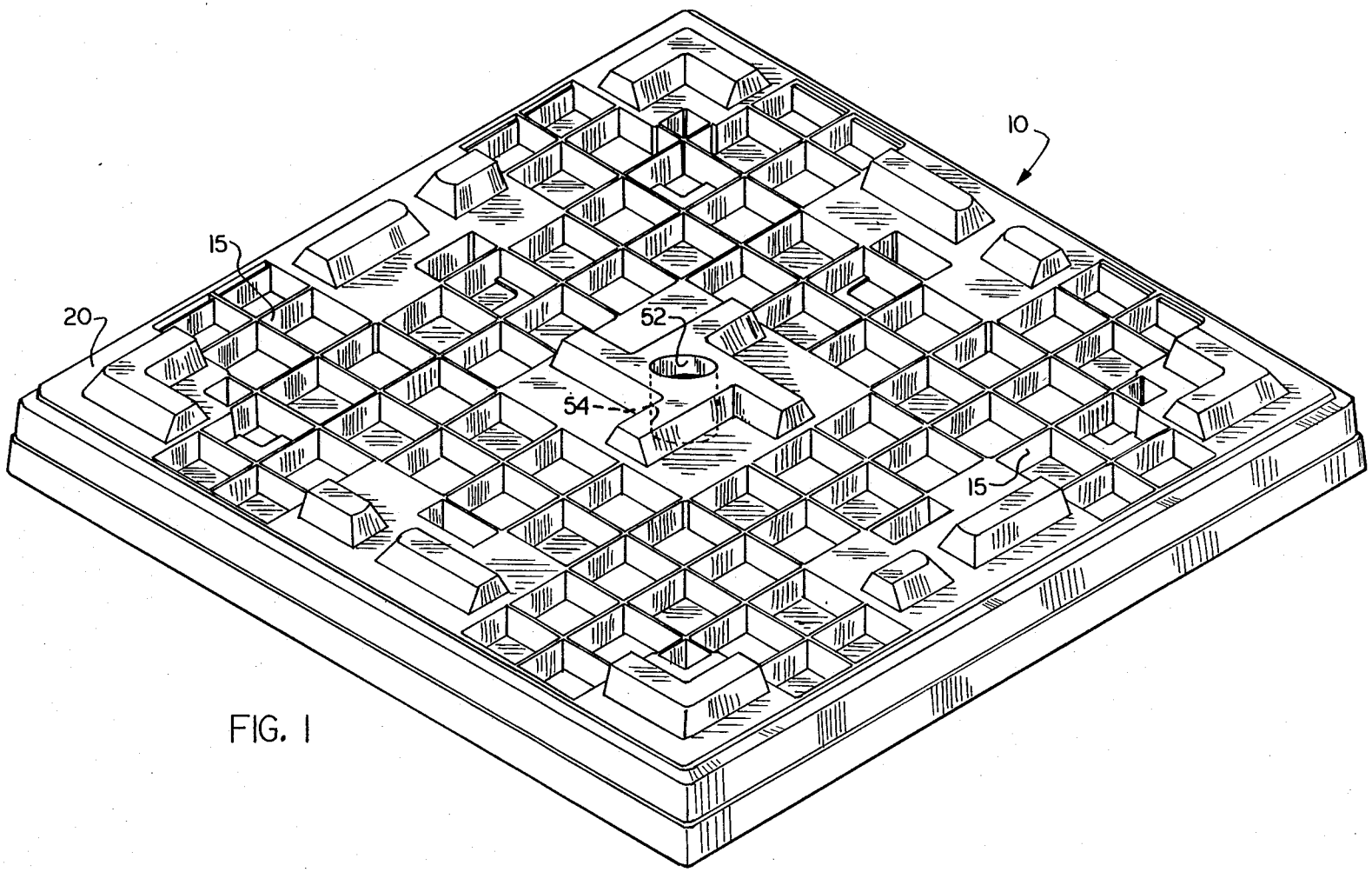
FIG. 1 is a perspective view, taken from the top and sides of the pallet, illustrating a preferred embodiment.
Figure 2:
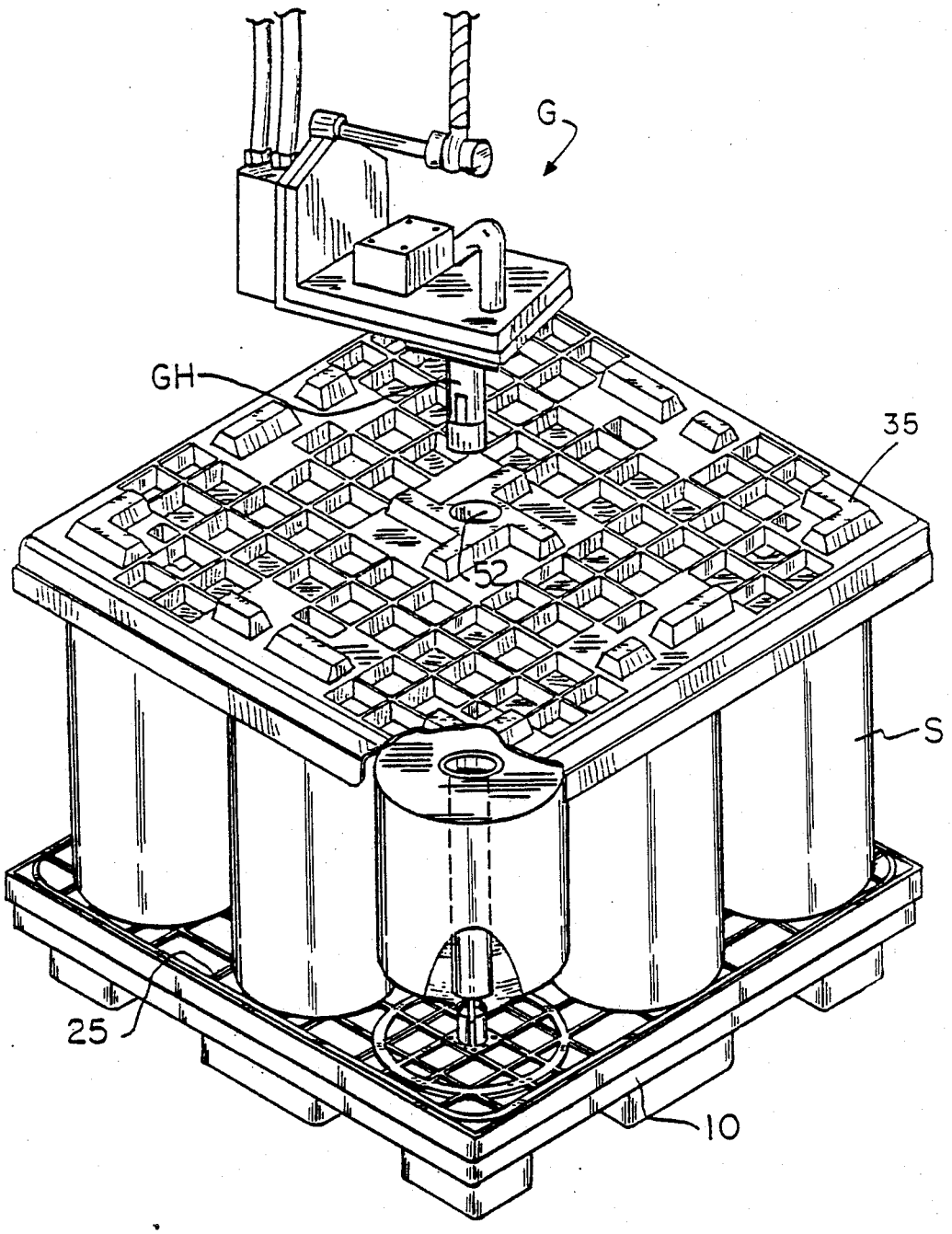
FIG. 2 is a perspective view of a yarn package utilizing the pallet of FIG. 1.
Figure 3:
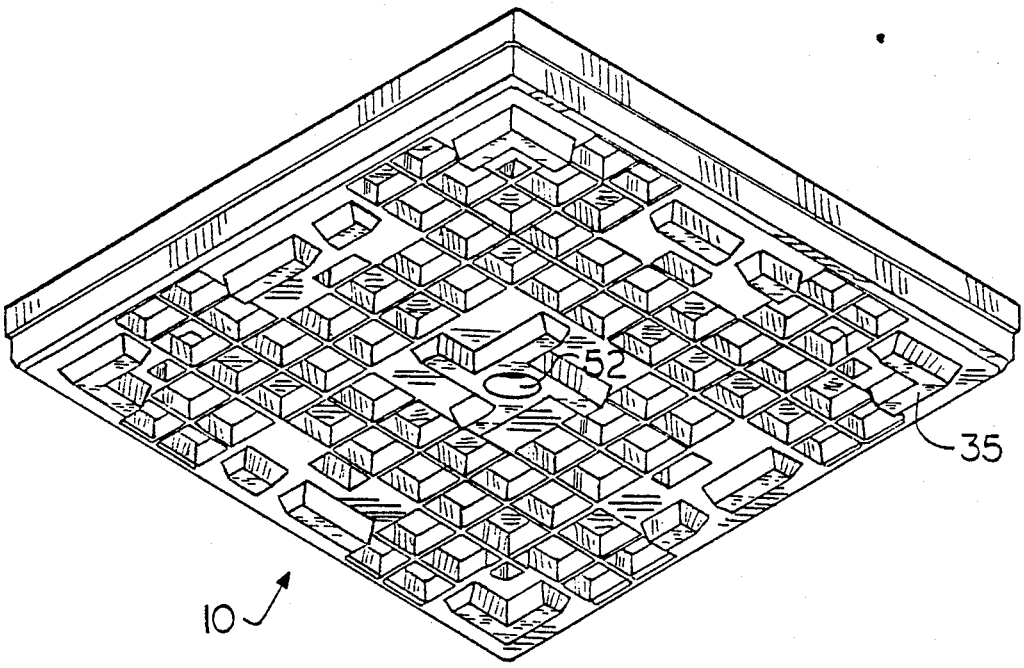
FIG. 3 is an exploded perspective of a stack of pallets.
Figure 3:
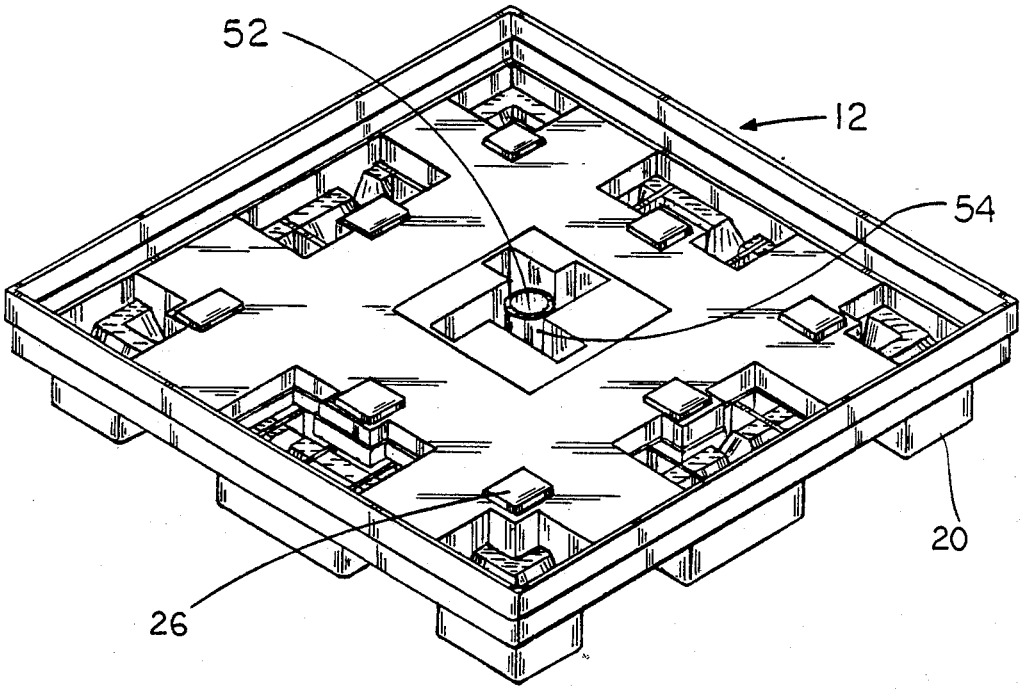

Looking first at FIG. 1, pallets 10 and 12 constructed according to a preferred embodiment include a grid-like structure wherein reinforcing members 15 are integrally molded across a substantial portion of the surfaces. Upwardly depending projections 35 also reinforce and stabilize the outer perimeters and the center of the pallet 10. These projections 35 further serve as feet which engage the undersurface of the pallet feet 20 when the pallet 12 is flipped over during one part of a stacking arrangement described below. The second pallet, 12, includes feet 20 which support the palletized unit above the floor sufficiently for the forks of a fork lift to be inserted therebetween to pick up the palletized unit. In the formation of a package as shown in FIG. 3, a pallet 12 with a separator grid 25 thereon, receives the yarn spools S arranged on the grid (a separator 30 overlies the pallet) and a pallet 10 is positioned on top of the spools with the reverse surface facing outwardly. Retaining bands or wrappers of shrink film (not shown) are utilized to hold the package together.

FIGS. 1–4 each illustrate a pallet gripping member which, in the preferred embodiment, is in the form of a centrally disposed aperture 52 defined by cylindrical sidewalls 54. The gripping aperture 52 generally is positioned in the center of the pallet, thus enabling the pallet to maintain some balance when being lifted and moved by the mechanical gripping device G.

Alternatively, two apertures are positioned in spaced apart relationship in the approximate center of the pallet. So arranged, the gripping device can engage either aperture. As previously described, the mechanical gripping device G may be any of several types; the one shown being of a type having a gripping head GH which is inserted into the cylinder or tube of the item to be lifted. By expansion or other friction engagement, the head GH holds the yarn spool, pallet, or other object thereon. Where such a gripping device is employed, the pallet will include at least one aperture 52 having an inner diameter equivalent to the inner diameter of the yarn tube 56.

Figure 4:
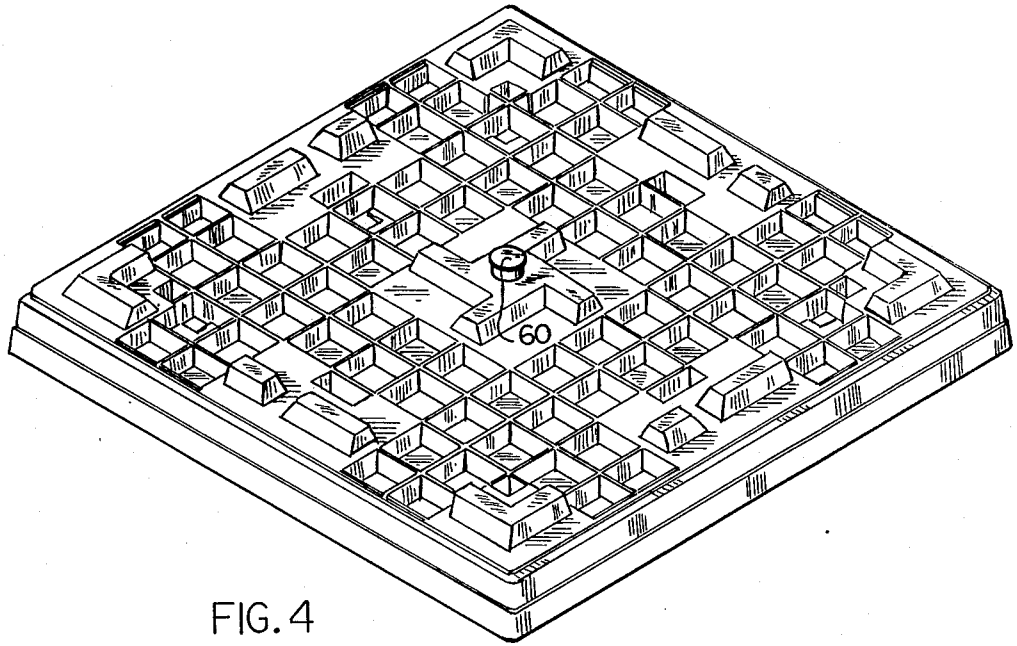
FIG. 4 is a perspective view of an alternate embodiment of the pallet.

An alternate pallet such as shown in FIG. 4 is designed for use with other types of products or gripping devices. Those products which require lifting by a type of gripping head (not shown) which uses gripping fingers to grasp and lift an object obviously cannot grip an aperture. In the FIG. 4 pallet, one or more centrally disposed vertical handles 60 are provided for grasping and lifting. The handles, although shown as having a vertically elongated knob-shaped configuration, might be formed in a variety of shapes.

Figure 5:
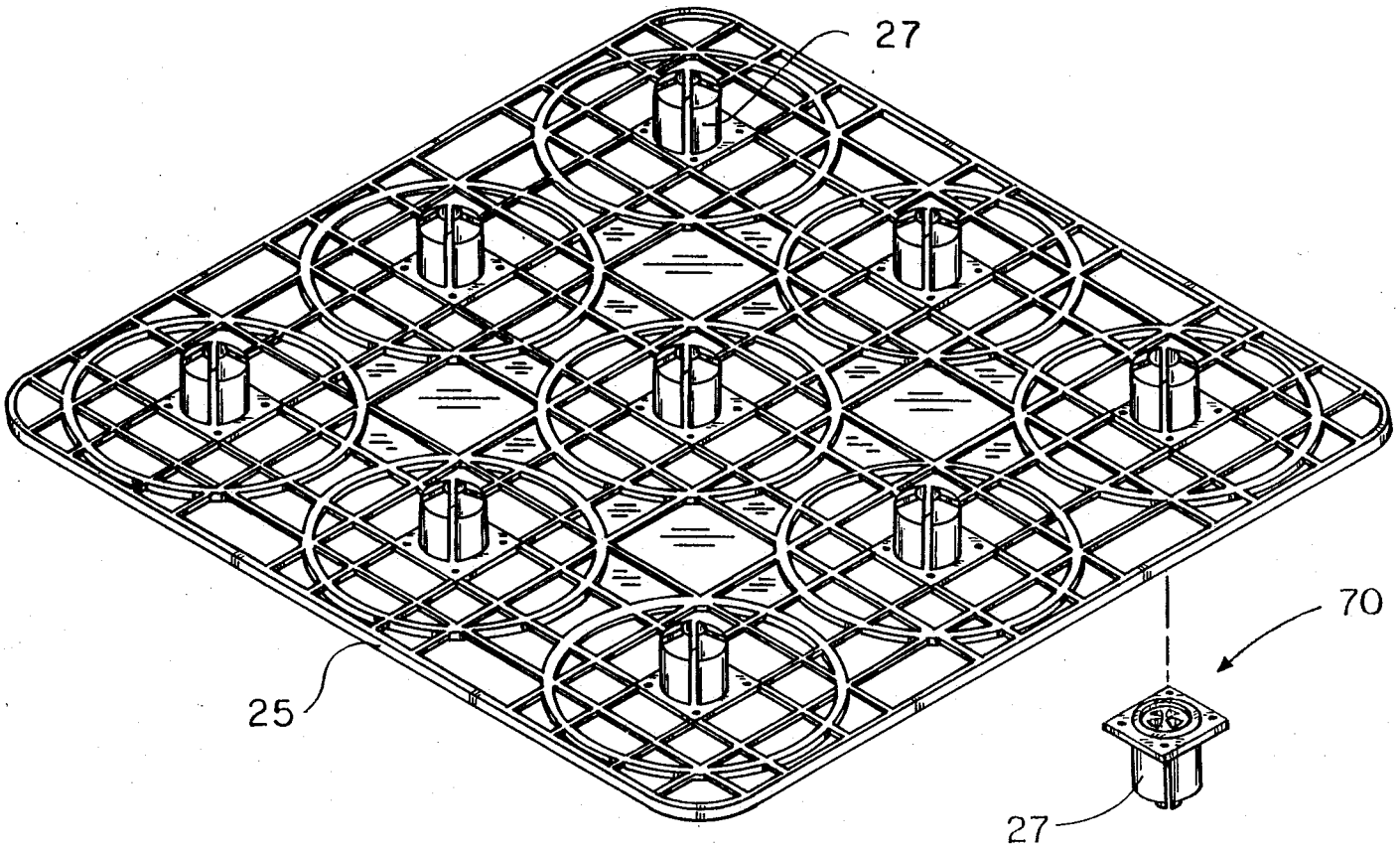
FIG. 5 is a perspective view of the separator grid and the detachable projection.

FIG. 5 illustrates the separator grid 25 which is substantially the same size as the goods-supporting surface of pallet 12. Preferably the grid is of square or rectangular shape to prevent rotation on the pallet. A plurality of vertical projections 27 depend upwardly therefrom, at spaced intervals, for insertion into the hollow tubes of the yarn packages. The grid 25 is placed between the supporting pallet and the yarn packages to prevent lateral shifting of the yarn. When the yarn packages are stacked more than one layer deep on the pallet, a grid 25 is placed between each layer to stabilize the tubes. For such intermediately placed grids, detachable projection means 70 are provided. These detachable projection means are screwed or otherwise fastened to the grid on the surface opposite the integral projection 27. These detachable projections are inserted into the tubes to further stabilize the package.

The pallets and separator grids shown and described herein generally are injection molded from high density polymers. The overall shape of the preferred embodiment is rectangular or square and will support a load of six to nine yarn packages on each pallet. The invention, however, is not limited to such materials or shape. The pallets can be designed in any shape or size for holding a variety of objects. While it is recognized that other modifications will become apparent to those skilled in the art, the invention is limited only by the scope of the claims below.

What is claimed is:

1. An apparatus for palletizing multiple individual packages of core wound strand material wherein the strand material is wound on a hollow cylindrical tube; said apparatus comprising:

(a) a supporting pallet having a planar support surface, and a plurality of feet arranged in spaced relationship underneath said planar surface;

(b) a separator grid for insertion between said planar support surface and the individual packages; said grid including a plurality of integrally molded vertical projections depending therefrom for engagement in said hollow tubes;

(c) detachable projection members for selectively mounting on the surface of said grid opposite each of said integral vertical projections;

(d) an intermediate separator grid for insertion between multiple layers of individual packages; said intermediate grid including a plurality of said detachable projection members mounted thereon for engagement in adjacent upper and lower packages;

(e) a covering pallet for overlying the uppermost layer of yarn packges; and (f) each of said supporting and covering pallets including a centrally disposed aperture defined by a cylindrical wall member extending through said pallet; said cylindrical wall having an inner diameter substantially equivalent to the inner diameter of the tubes on which said yarn packages are wound.

* * * * *